United States Patent [19]

Solomon

[11] Patent Number: 4,897,770

[45] Date of Patent: Jan. 30, 1990

[54] SYMMETRICAL COLOR CHANGER SYSTEM

[76] Inventor: Dennis Solomon, 58 Miriah Dr., Yarmouth Port, Mass. 02675

[21] Appl. No.: 164,397

[22] Filed: Mar. 4, 1988

[51] Int. Cl.[4] ..... F21V 9/00

[52] U.S. Cl. ..... 362/293; 350/315; 350/316

[58] Field of Search ..... 350/313, 315; 362/16, 362/18, 293

[56] References Cited

U.S. PATENT DOCUMENTS 4,080,050 3/1978 Huber ..... 350/315

4,602,321 7/1986 Bornhorst ..... 362/293 X

*Primary Examiner*—Stephen F. Husar

*Attorney, Agent, or Firm*—Lackenbach Siegel Marzullo & Aronson

[57] ABSTRACT

A color changer system including a pair of slidable color filter plates or a pair of rotatable color filter disks positioned on opposed side of a beam aperture through which a beam of white light passes. The pair of filter plates or filter disks are simultaneously movable or rotatable, respectively, across the beam aperature orthogonal to the beam axis so as to enhance a particular color. The movement of the filter plates or disks are movable into the beam symmetrical to the center of the beam aperture so that distribution of color saturation of the beam is symmetrical about the center of the beam aperture during movement of said first and second color filter means. Progressive variable filtering regions defining a plurality of color enhancing capacities either included diffused color filtering material or dichroic color filtering material. When the dichroic color filtering material is used, alternating clear and dichroic filtering strips are located in each filtering region. When the pair filter plates or filter disks overlap, the clear and dichroic filtering strips of each pair complement so that the lightwaves of the beam are filtered through only one of the pair of plates or strips.

20 Claims, 4 Drawing Sheets

SYMMETRICAL COLOR CHANGER SYSTEM

FIELD OF THE INVENTION

This invention relates to the transmission of selected densities of colored light through color filters, and in particular the invention relates to a system for chromatic control of the output beam of theatrical lighting fixtures.

BACKGROUND OF THE INVENTION

Neutral density filters are well-known the art of theatrical lighting for the stage and related fields. Traditionally, colored filters are placed across the light beam.

A strip filter slide plate having the capability of transmitting light of varied intensities is positioned in operational association with an aperture through which a beam of light passes. The strip filter plate is moved across the beam of light so that the color saturation of the transmitted light is gradually increased or decreased in accordance with the position of a selected area of color density moved across the path of the liqht beam. Filters of the primary colors placed one behind the other are operated in series to create a desired color at a particular saturation level. Another configuration of a filter of a color changer is a rotatable disk having regions of variable intensity in the same manner as the strip filter plate type color changer.

The type of filters used in the art until recently has been absorption filters, which are generally made of glass. Spraying of color filter material on a translucent material is also done. A filter which passes a color of a particular wavelength, such as blue, for example, is moved across a beam aperture so that wavelengths of light not blue are absorbed. The density of the translucent colored material gradually changes so that the saturation level of the selected color transmitted can be gradually increased or decreased.

Recently, multilayered interference filters, also called dichroic filters, have been employed in color changing systems. The dichroic technique exploits subtractive chromatic characteristics of color-temperature-stabilized light sources. In brief, the dichroic technique comprises a multilayer interference filter construction which alternates layers of translucent material of different refractive indices so as to cause selective interference of wavelengths with the exception of the wavelength of the color that is to be enhanced. For example, if blue is to be enhanced by 10 percent, the dichroic filter interferes with, thus reducing, the remaining wavelengths of the visible spectrum by an approximate 10 percent factor leaving the blue wavelength transmitted intact with the color blue enhanced by its increased presence relative to the total wavelength presence of the remaining light beam.

Dichroic filters because of their reflective capability are much cooler and have fewer scattering losses than absorptive filters with the result that the dichroic filters have a 5–10% output advantage over absorptive filters.

A problem of filtering devices in general is that the degree of color saturation of the light beam varies across the aperture of the beam primarily because the filter is moved from one side of the beam aperture to the other side and is also positioned in place so that the color saturation varies across the beam aperture and likewise at the beam termination. This undesirable effect is especially noticeable during the change from one color or color saturation level to another.

SUMMARY OF THE INVENTION

Accordingly, it is an object of the present invention to provide a color filtering system which creates a general even level of color saturation across the aperture of the beam of light during the movement of the filtering system.

It is also an object of this invention to provide a color filtering system which provides a filter which includes at least two mating color slide filters which are simultaneously moved from opposite sides of the aperture of the beam of light across the aperture so that the level of color saturation of the light beam is generally even during movement of the slide filters.

It is another object of the present invention to provide a color filtering system of the type controlling color saturation by the dichromatic technique which increases the efficiency of maintenance of beam intensity relative to the degree of color enhancement.

In accordance with these purposes and others which will become evident in the course of the discussion, the present invention provides a color changer system including a pair of slidable color filter plates or a pair of rotatable color filter disks positioned on opposed side of a beam aperture through which a beam of white light passes. The pair of filter plates or filter disks are simultaneously movable or rotatable, respectively, across the beam aperture orthogonal to the beam axis so as to enhance a particular color. The movement of the filter plates or disks are movable into the beam symmetrical to the center of the beam aperture so that distribution of color saturation of the beam is symmetrical about the center of the beam aperture during movement of said first and second color filter means. Progressive variable filtering regions defining a plurality of color enhancing capacities either included diffused color filtering material or dichroic color filtering material. When the dichroic color filtering material is used, alternating clear and dichroic filtering strips are located in each filtering region. When the pair filter plates or filter disks overlap, the clear and dichroic filtering strips of each pair complement so that the lightwaves of the beam are filtered through only one of the pair of plates or strips. Filtering light through one rather than two filtering regions results in a greater efficiency in passing wavelengths of the desired frequency. The result of such greater efficiency is a decrease in energy consumption required to illuminate a required surface, environment, or stage.

The present invention will be better understood and the objects and important features, other than those specifically enumerated above, will become apparent when consideration is given to the following details and description, which when taken in conjunction with the annexed drawings, describes, discloses, illustrates, and shows a preferred embodiment or modification of the present invention and what is presently considered and believed to be the best mode of practice in the principles thereof.

DESCRIPTION OF THE PREFERRED EMBODIMENTS

Figure 1:
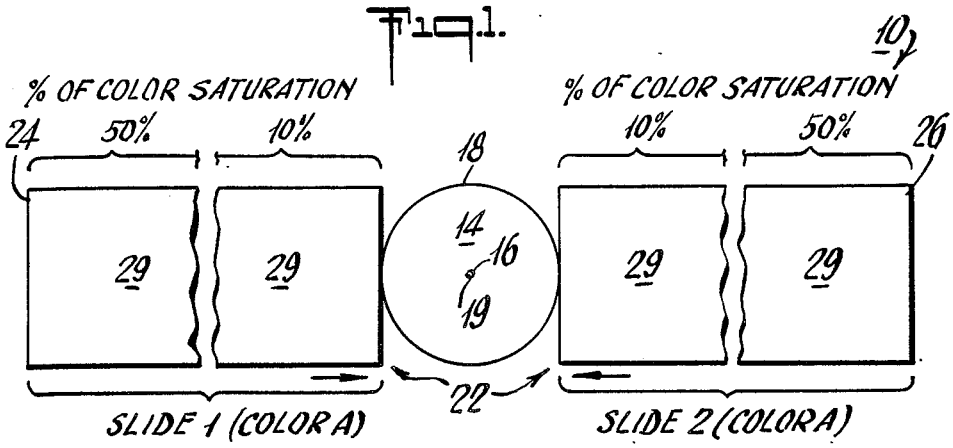
FIG. 1 illustrates a front view of a two-plate filter system positioned ready for movement across a light aperture.

Reference is now made in detail to the above figures wherein numerals correspond to the same or similar elements throughout.

A symmetrical color changer system 10 illustrated in FIGS. 1–4 and 8 includes a source 12 of white light emitting a light beam 14 having an axis of propagation 16 and a beam aperture 18 through which light beam 14 passes. Symmetrical color changer system 10 includes a symmetrical color filter unit 22 which includes first and second color filter plates 24 and 26, respectively, which are positioned in opposed relationship adjacent to beam aperture 18 in horizontal alignment. The elements of color changer system 10 are supported by a structure 27 indicated in phantom line in FIG. 4. First and second color filter plates 24 and 26 are movable horizontally across beam aperture 18 orthogonal to beam axis 16, wherein selected lightwaves of beam 14 are deleted in predetermined amounts in accordance with the positions of first and second color filter plates 24 and 26 so as to enhance a particular color, designated color "A" in the figures, contained in light beam 14. First and second color filter plates 24 and 26 are simultaneously movable across beam 14 continuously symmetrical to beam axis of propagation 16 so that distribution of color saturation of beam 14 is symmetrical about center 19 of beam aperture 18 during both the movement and the final positioning of first and second color filter plates 24 and 26. First and second color filter plates 24 and 26 each include five progressive variable filtering regions 29 shown in FIGS. 1-3 ranging as percents of color filtering capacity relating to color A ranging between 10 percent and 50 percent in 10 percent incremental ranges each large enough in area to cover the area of beam aperture 18. The color densities of each filtering region 29 differ from one another but are evenly distributed throughout each filtering region 29. Lightwaves of selected wavelengths are deleted in variable amounts in accordance with which filtering region 29 is positioned across the beam aperture 18 while all the lightwaves of color A are transmitted.

Filter plates 24 and 26 are simultaneously driven towards or away from beam aperture 18 by mechanisms known in the art. These mechanisms can be manually driven or be driven by a rack-and-pinion, a lever, or a cam, or by a remote controlled position-control mechanism such as a voice-coil driver. Filter plates 24 and 26 can be optionally individually driven. Driver mechanisms 28 and 30, a remote control panel 32, and control signal lines 34 are schematically indicated in phantom line in FIG. 4.

First and second color filter plates 24 and 26 are each movable to selected positions across beam aperture 18 so as to intercept beam 14. Regions 29 can be selectively positioned across beam aperture 18 orthogonal to beam axis 16 so as to achieve a selected enhancement of color A. Filtering regions 29 have color filtering material which is randomly diffused on first and second color filter plates 24 and 26 in varying densities in regions 29 in proportion to the degree of filtering capacity. Filtering regions 29 are shown as defined in 10 percent ranges between 0 percent and 50 percent for purposes of exposition, but these ranges can vary.

Figure 2:
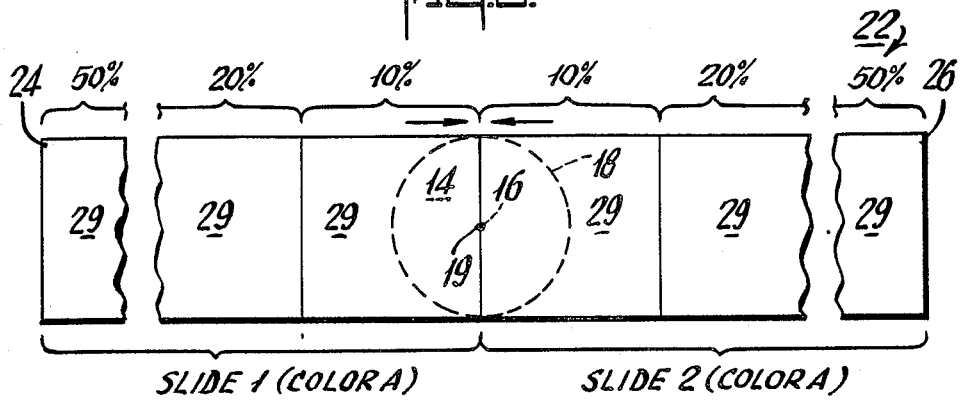
FIG. 2 illustrates the two-plate filter system shown in FIG. 1 with the two plates moved half-way across the light aperture.

FIG. 2 illustrates plates 24 and 26 having been moved to a midposition relative to center 19 of beam aperture 18 so that beam 14 is intercepted in the 10 percent density ranges. Thus, color A is transmitted in its entirety while approximately 10 percent of the wavelengths of the remainder of the white light spectrum are intercepted.

Figure 3:
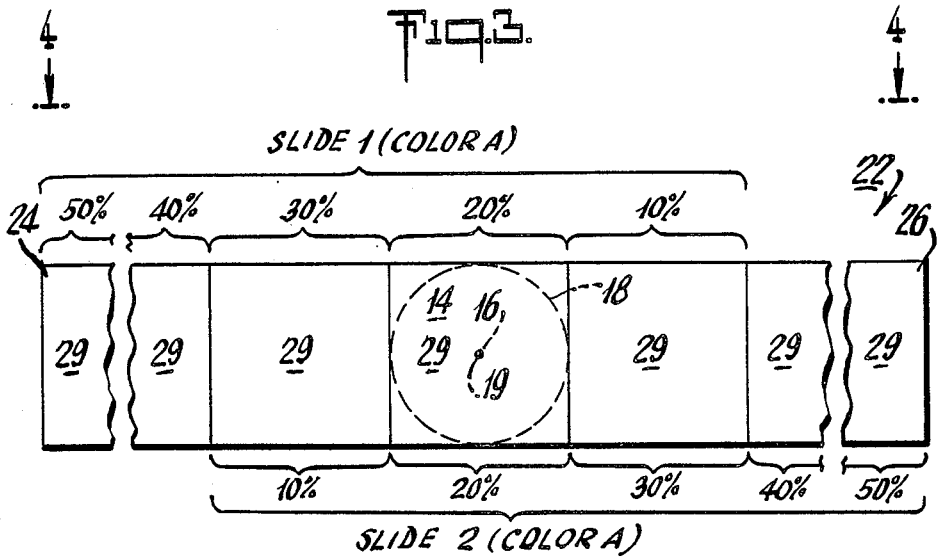
FIG. 3 illustrates the two-plate filter system shown in FIGS. 1 and 2 with the two plates moved into an overlapping relationship.

In FIG. 3, plates 24 and 26 have been further moved to overlapping positions so that two 20 percent ranges of a filtering region 29 are positioned across beam aperture 18. The effect of color enhancement of color A in the overlapping position is additive, namely, approximately 20 percent enhancement through filter plate 24 and approximately 20 percent enhancement through filter plate 26 so that the total enhancement of color A is somewhat less than 40 percent. Precise enhancements can be calculated and the quantity of filter density material required for each range can be placed into or o each of filter plates 24 and 26.

An interim position (not shown) of filter plates 24 and 26 between the positions of plates 24 and 26 a illustrated in FIGS. 2 and 3 would be overlapping positions of plates 24 and 26 across beam 14 in the 10 percent density range for an additive color enhancement of color A of somewhat less than 20 percent.

Figure 4:
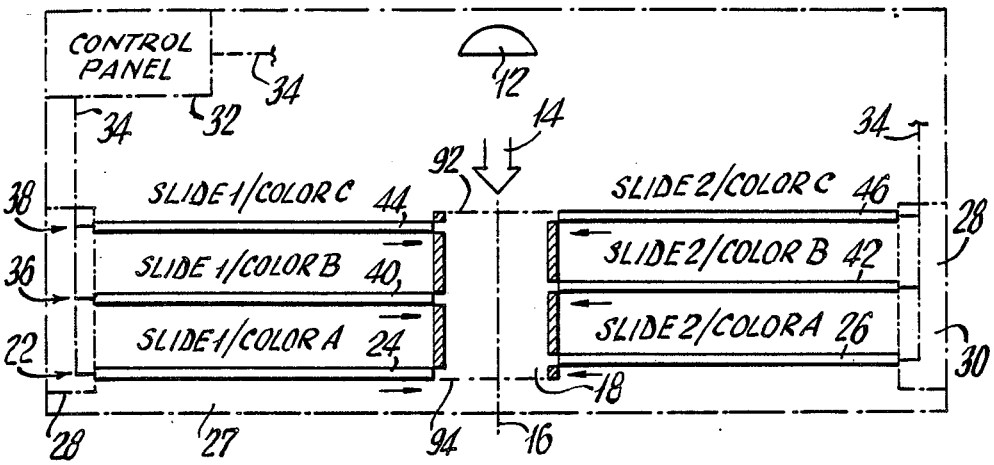
FIG. 4 is a view taken along line 4-4 in FIG. 3.

FIG. 4 illustrates three symmetrical color filter units mounted to support structure 20 including symmetrical color filter unit 22 discussed above, and symmetrical color filter units 36 and 38 for enhancement of primary colors "B" and "C", respectively, positioned in the manner of symmetrical color filter unit 22. Color filter plates 40 and 42 of symmetrical color filter unit 36 and color filter plates 44 and 46 of symmetrical color filter unit 38 can be moved across beam aperture 19 orthogonal to beam axis 18 so as to enhance their particular colors B and C in the manner described for symmetrical color filter unit 22. Colors A, B, and C represent three primary colors of the light spectrum. For example, the unit nearest beam 14, symmetrical color filter unit 38 would enhance cyan (blue); the next color unit 36 would enhance magenta (red); and the distal color unit 22 would enhance yellow. Selected lightwaves of beam 14 are deleted in predetermined amounts in accordance with the positions of first and second color filter plates 24, 26; 40, 42; and 44, 46. First and second color filter plates 24, 26; 42, 44; and 44, 46 are simultaneously movable across beam 14 continuously symmetrical to beam axis of propagation 16 so that distribution of color saturation of beam 14 is symmetrical about center 19 of beam aperture 18 during both the movement and the final position of the three symmetrical color filter units 22, 36 and 38. First and second color filter plates 42, 44 and 44, 46 each include progressive variable filtering regions as percents of color saturation ranging between 0 percent and 50 percent analogous to those shown in FIGS. 1-3. Symmetrical color filter units 36 and 38 are controlled at control panel 32 and operated by driver mechanisms 28 and 30.

Symmetrical color filter units 22, 36, and 38 are optionally operable so that their first and second color filter plates can be moved independently of one another. This independent control provides added options for the selection of ranges of enhancement. For example, movement of the 10 percent enhancement of the first color filter plate across beam aperture 18 and the 20 percent enhancement of the second color filter plate across beam aperture 18 will result in a color enhancement of an approximate 10 percent reduction of other colors than the designated color across the first color filter plate and an approximate 20 percent reduction of the approximately 90 percent of remaining other lightwaves of other colors than the designated color across the second color filter plate for an approximate 23 percent total reduction of other colors resulting in an approximate 27 percent enhancement of the designated color.

Figure 8:
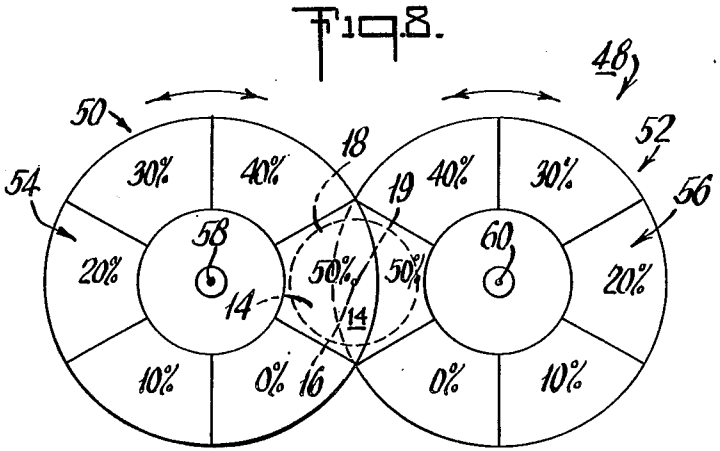
FIG. 8 illustrates a two-disk filtering system using alternate non-overlapping filtering regions with the disks positioned across the light aperture.

FIG. 8 illustrates a symmetrical color filter unit 48 which includes first and second color filter disks 50 and 52, respectively, positioned on opposite sides of beam aperture 18. First and second disks 50 and 52 are rotatably movable across the beam aperture to a plurality of selected positions so as to achieve a selected enhancement of a particular color. First and second filter disks 50 and 52 each include circumferential toroidal regions 52 and 54, respectively, divided into six variable filtering regions indicated as 0 percent, 10 percent, 20 percent, 30 percent, 40 percent and 50 percent, designations which indicate general color enhancement capability of the incremental areas of the filtering regions. The area of each enhancement range is capable of covering the area of beam aperture 18. The filtering regions designated 0 percent are either 100 percent translucent or alternatively are devoid of disk material. The remaining five filtering regions of toroidal regions 52 and 54 have color filtering material which is randomly diffused in varying densities in filtering regions 29 in proportion to the degree of filtering capacity. First and second color filter disks 50 and 52 and in particular toroidal regions 54 and 56 are rotatable across beam aperture 18 orthogonal to beam axis 16, so that the six variable filtering regions, that is, the five regions having color filtering material and the remaining region devoid of color filtering material, can be selectively positioned across beam aperture 18. Selected lightwaves of beam 14 are deleted in predetermined amounts in accordance with which one of the five variable filtering regions is being positioned or is positioned across beam aperture 18. First and second color filter disks 50 and 52 are simultaneously rotatable across beam 14 continuously symmetrical to beam aperture 18. Beam aperture 18 has an aperture diameter and circumferential toroidal regions 54 and 56 have a toroidal band width at least equal to the diameter of beam aperture 18.

First and second color filter disks 50 and 52 are mounted to a support structure and are rotated about their respective axes of rotation 58 and 60 by driver mechanisms either hand controlled or remotely controlled. The support structure and mechanisms are generally analogous to those discussed relative to symmetrical color filter unit 22 earlier. Symmetrical color filter unit 48 is mounted with at least two other symmetrical color filter units (not shown) analogous to symmetrical color filter units 36 and 38 so that the primary colors of the visible spectrum are available for transmitting a mix of colors.

Figure 5:
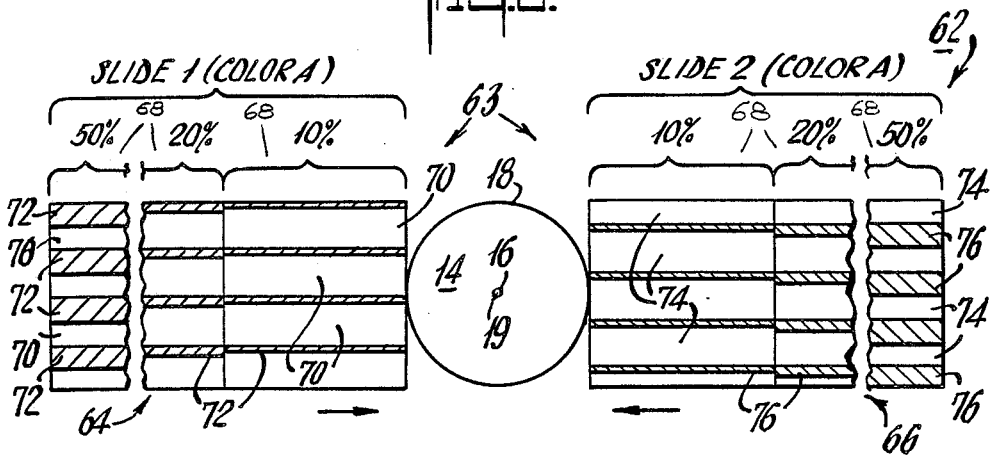
FIG. 5 illustrates a front view of a two-plate filter system using alternate non-overlapping filtering regions with the filters positioned ready for movement across a light beam aperture.
Figure 6:
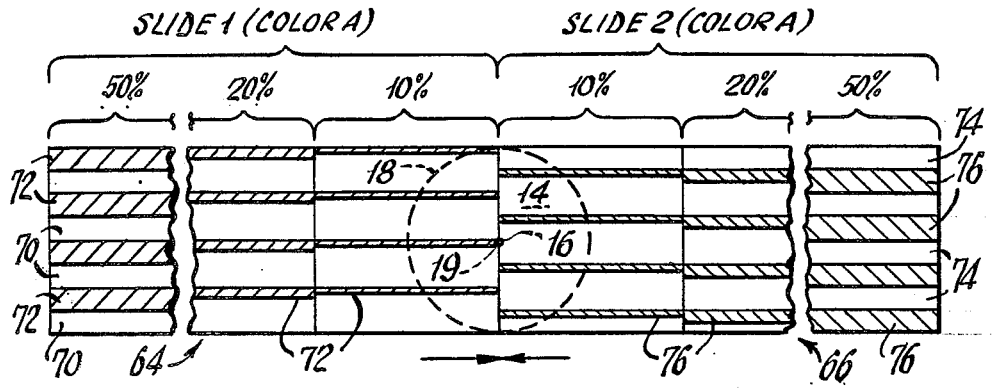
FIG. 6 illustrates the two-plate filtering system shown in FIG. 5 with the two plates each moved halfway across the light beam aperture.
Figure 7:
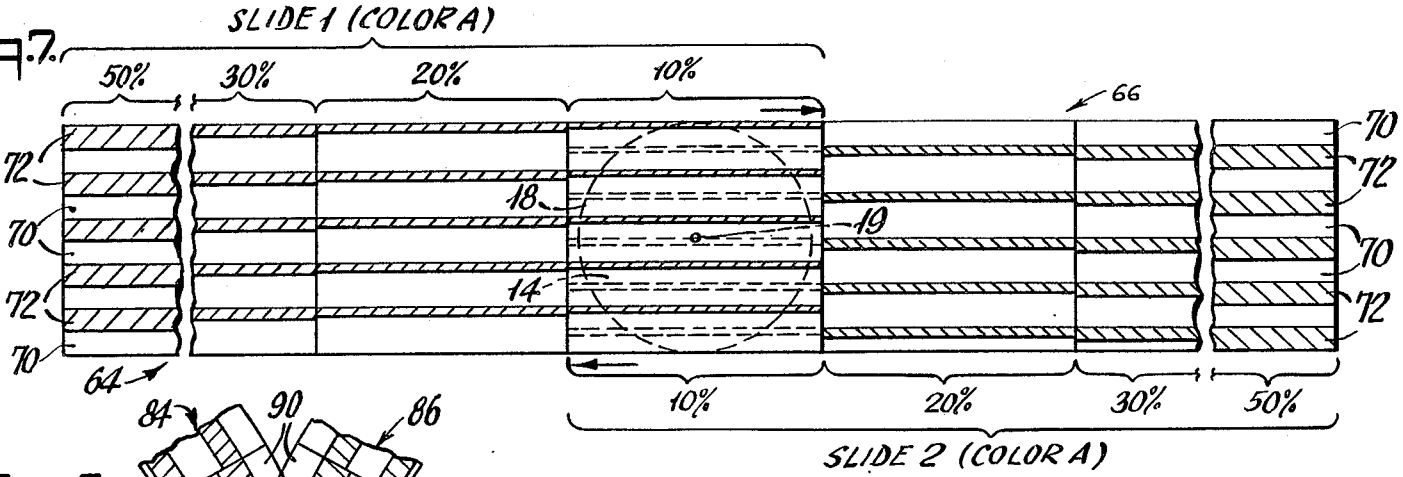
FIG. 7 illustrates the two-plate filtering system shown in FIGS. 5 and 6 with the two plates moved into a overlapping relationship.

FIGS. 5-7 illustrate a dichroic symmetrical color filter system 62 including a dichroic color filter unit 63 generally analogous to symmetrical color filter system 10 and symmetrical color filter unit 22 described above except that the color filtering material is distributed on each pair of mating filters so that the primary beam at most passes through only one of the filtered areas thus increasing beam intensity relative to the degree of color enhancement. In particular, dichroic color filter system 62 includes a symmetrical color filter unit 63 including first and second dichroic color filter plates 64 and 66, respectively, which are positioned in opposed relationship adjacent to beam aperture 18 in horizontal alignment. First and second dichroic color filter plates 64 and 66 are movable across beam aperture 18 orthogonal to beam axis of propagation 16, wherein selected lightwaves of beam 14 are deleted in predetermined amounts in accordance with the positions of first and second dichroic color filter plates 64 and 66 so as to enhance a particular color, designated color "A" in the figures, contained in said light beam 14. First and second dichroic color filter plates 64 and 66 are simultaneously movable across beam 14 continuously symmetrical to beam axis of propagation 16 so that distribution of color saturation of beam 14 is symmetrical about center 19 of beam aperture 18 during the movement of first and second dichroic color filter plates 64 and 66.

First and second dichroic color filter plates 64 and 66 each include five progressive variable filtering regions shown in FIGS. 5-7 as percents of color saturation ranging between 0 percent and 50 percent extending from the lowest percents to the highest percents relative to beam aperture 18. The color densities of dichroic filter plates 64 and 66 precisely define incremental areas of the filtering regions indicated in FIGS. 5-7 as 10 percent ranges large enough in area to cover the area of beam aperture 18. Dichroic filter plates 64 and 66 are simultaneously driven towards or away from beam aperture 18 by mechanisms known in the art in the same manner as symmetrical color filter unit 22 of symmetrical color changer system 10 as illustrated in FIG. 4. Each of the five regions 68 have clear, or unfiltered, portions and dichroic color filtering portions.

Each filtering region 68 of first dichroic filter plate 64 has alternating clear portions 70 and dichroic color filtering portions 72; and each filtering region of second dichroic filter plate 66 has alternating clear portions 74 and dichroic filter portions 76. Each clear portion 70 and dichroic filtering portion 72 of each filtering region 68 of first dichroic filter plate 64 complements each clear portion 74 and dichroic color portion 76 of second dichroic filter plate 66 so that when first and second dichroic color plates 64 and 66 are moved into overlapping positions wavelengths of light beam 14 are filtered through only one of either dichroic filter portions 72 or 75, that is, the color A is filtered through only one of dichroic filter plates 64 or 66. Dichroic filter portions 72 and 76 are distributed in progressively greater proportion relative to clear portions 70 and 74 of filter regions 68 of first and second dichroic filter plates 64 and 66 in proportion to the increase of degree of color enhancement capability of color A. Clear portions 70 and 74 and dichroic portions 72 and 76 are configured as elongated rectangular strips distributed in spaced relationship within each of progressive variable filtering region 68.

Dichroic symmetrical color changer system 62 includes preferably two additional symmetrical dichroic filter units in addition to dichroic filter unit 63 for adding primary colors B and C to the system in a manner analogous to symmetrical color units 36 and 38 described above in relation to symmetrical color changer system 10 and as shown in FIG. 4.

FIG. 6 illustrates plates 64 and 66 having been moved to a midposition relative to center 19 of beam aperture 18 so that beam 14 is intercepted either by dichroic filter portion 72 or 76 in the 10 percent density range. Beam 14 passes unfiltered through clear portions 70 and 74. Color A is transmitted in its entirety while approximately 10 percent of the wavelengths of the remainder of the white light spectrum are intercepted.

In FIG. 7, plates 64 and 66 have been further moved to overlapping positions so that two 20 percent ranges of a filtering region 29 are positioned across beam aperture 18. The effect of color enhancement of color A in the overlapping position is additive, namely, approximately 20 percent enhancement through filter plate 64 and approximately 20 percent enhancement through filter plate 66 so that the total enhancement of color A is somewhat less than 40 percent. Precise enhancements can be calculated and the needed filter density materials can be placed into or on each of the pair of filter plates.

An interim position (not shown) of filter plates 64 and 66 between the positions of plates 64 and 66 as illustrated in FIGS. 6 and 7 would be overlapping positions of plates 64 and 66 across beam 14 in the 10 percent density range for an additive color enhancement of color A between 10 and 20 percent.

Figure 9:
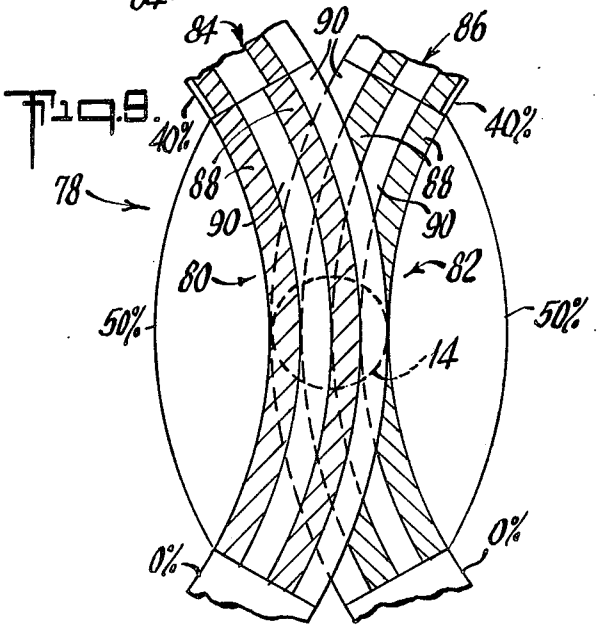
FIG. 9 illustrates an enlarged detail at the light aperture of the two-disk filtering system shown in FIG. 8.

A dichroic symmetrical color filter unit 78 analogous to symmetrical color filter unit 48 illustrated in FIG. 8 is illustrated in broken away detail view in FIG. 9. First and second dichroic symmetrical filter disks 78 and 80 generally analogous in configuration to first and second filter disks 50 and 52, respectively, are rotatably positioned on opposite sides of beam aperture 18. First and second disks 80 and 82 are rotatably movable across the beam aperture to a plurality of selected positions so as to achieve a selected enhancement of a particular color, such as color A. First and second filter disks 80 and 82 each include a circumferential toroidal region 84 and 86, respectively, divided into six variable filtering regions of 0 percent, 10 percent, 20 percent, 30 percent, 40 percent and 50 percent, which indicate general amounts of color enhancement of the particular color to be enhanced by symmetrical color filter unit 78. The color densities of five of filtering regions of 10 percent to 50 percent of the toroidal filtering regions 84 an 86 precisely define incremental areas of the filtering regions. The filtering regions designated 0 percent are either 100 percent translucent or alternatively are devoid of disk material. Filtering regions 84 and 86 are configured to cover the entire area of beam aperture 18. The remaining five filtering regions of toroidal regions 84 and 86 each include alternating clear portions 88 and dichroic color filtering portions 90. Clear portions 88 and dichroic filter portions 90 are configured as arced strips distributed in spaced relationship within each of the progressive variable filtering regions 10, 20, 30, 40, and 50 percent. The areas of dichroic filter portions 90 increase relative to the area of clear portions 88 as the degree of color saturation to be transmitted increases, that is, in accordance with the increasing filtering capacities of the 10 percent to 50 percent filtering regions. Beam aperture 18 has an aperture diameter and each circumferential toroidal region 84 and 86 has a toroid width at least equal to the aperture diameter, the toroidal region being positioned across beam aperture 18. First and second dichroic filter disks 80 and 82 are rotatable about their axes so that the six variable filtering regions, that is, the five regions having dichroic filtering material and the remaining region devoid of filtering material, can be selectively positioned across beam aperture 18 orthogonal to beam axis 16. Selected lightwaves of beam 14 are deleted in predetermined amounts in accordance with the positions of first and second color filter disks 80 and 82, that is, the positioning of one of the five variable filtering regions so as to enhance a particular color contained in light beam 14. First and second color filter disks 80 and 82 are simultaneously rotatable across light beam 14 continuously symmetrical to beam center 19 so that distribution of color saturation of light beam 14 is symmetrical about center 19 of beam aperture 18 during the movement of first and second color filter disks 80 and 82. Clear portions 88 and dichroic portions 90 of first dichroic filter disk 80 complement clear portions 88 and dichroic portions 90 of second dichroic filter disk 82, so that when first and second dichroic color disks 80 and 82 ar moved into overlapping positions, wavelengths of light beam 14 are filtered through only one of dichroic portions 90 of first and second dichroic filter disks 80 and 82.

First and second color filter disks 80 and 82 are mounted to a support structure and are rotated about their respective axes of rotation by driver mechanisms either hand controlled or remotely controlled. The support structure and mechanisms of dichroic symmetrical color changer unit 78 are generally analogous to symmetrical color filter unit 22 and to dichroic symmetrical color filter unit 63 discussed earlier. Symmetrical color filter unit 78 is mounted with at least two other symmetrical color filter units analogous to symmetrical color filter units 36 and 38 so that the primary colors of the visible spectrum are available for transmitting a mix of colors.

Beam aperture 18 has proximal and distal planes 92 and 94, respectively, relative to light source 12 (FIG. 4). Each of the filter plates and filter disks discussed herein preferably are positioned approximately parallel to distal plane 94. Alternatively, each of the filter plates and the filter disks can be positioned approximately parallel to proximal plane 92.

Figure 10:
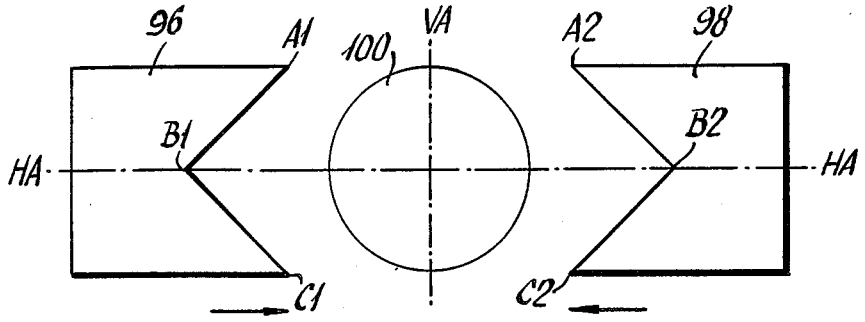
FIG. 10 is a frontal schematic view of a two-plate filter system with the front edge of each plate notched with the plates spaced from the beam of light.
Figure 11:
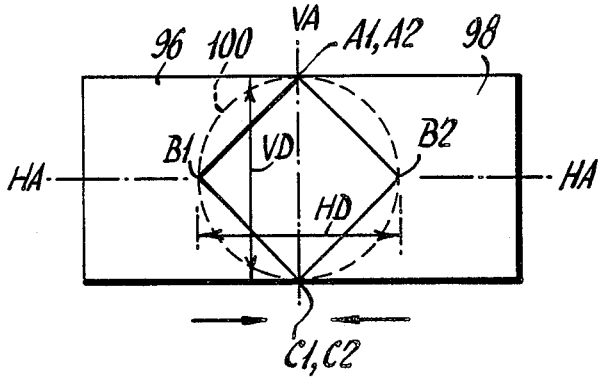
FIG. 11 is a view similar to that illustrated in FIG. 10 with the front edge of the two plates moved to a position of partial interference with the beam of light.
Figure 12:
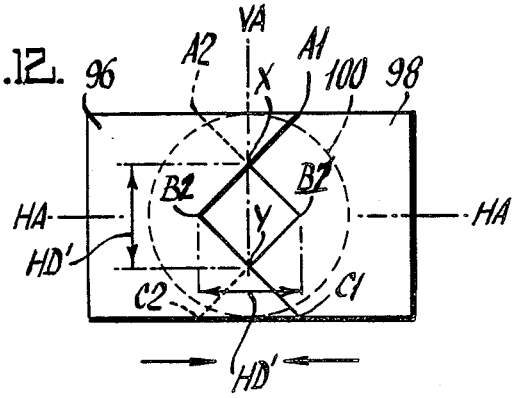
FIG. 12 is a view similar to that illustrated in FIGS. 10 and 11 with the two plates having been moved further across the beam of light.

FIGS. 10, 11 and 12 illustrate two plates 96 and 98 on the left and right sides, respectively, of circular light beam 100, and which form triangular notches along their front edges that first come into contact with light beam 100 when activated to move into filtering position. Beam 100 is generally of uniform optical or spectral density. The notches of plates 96 and 98 are defined by points A1, B1, C1 and points A2, B2, C2, respectively. Points A1 and A2 define the tops of the triangles, points B1 and B2 define the midpoints of the triangles, and points C1 and C2 define the bottoms of the triangles. As plates 96 and 98 are moved toward filtering positions as shown in FIG. 12, points A1 and A2 meet at the top of vertical axis VA of beam 100 and points C1 and C2 meet at the bottom of vertical axis VA. Points B1 and B2 are at the outer side edges of horizontal axis HA of beam 100. As shown in FIG. 12, the two notches form a square defined by points A1 ,A2, B2, C1 ,C2, and B1. Also, the vertical distance VD between points Al, A2 and C1, C2 is equal to the horizontal distance HD between points Al and B2. As plates 96 and 98 are moved further into actual filtering position across beam 100 as illustrated in FIG. 13, side points B1 and B2 are located at positions in the path of beam 100 with areas of plates 96 and 98 filtering portions of beam 100. A portion of beam 100 is unfiltered, namely a square defined by points B1 and B2 along horizontal axis HA and by top point X and bottom point Y on vertical axis VA. Here vertical distance VA' between points X and Y and horizontal distance HA' between points B1 and B2 are equal so that again a square is formed, although considerably smaller than the square formed in FIG. 11. In this manner, as plates 96 and 98 are moved into filtering position across beam 100, smaller and smaller squares are formed with the result that the light rays of beam 100 that pass on to the stage or other final destination in an unfiltered state are always at the general center of beam 100 so that the filtered area surrounding the central square gradually, and not obtrusively, closes (or opens) around the center of beam 100. The result is that filtering of the light beam is accomplished in a much more aesthetic manner compared to a general line of filtered and unfiltered light moving across a stage.

As noted above, beam 100 is of general uniform density with its rays being radially distributed at generally equal distances parallel to the beam axis. Such a beam is generated by an arc lamp system. In a filament lamp system, the light beam is not uniform relative to the center of the beam. The task of isolating such a beam of light so that it passes a beam of equal density onto the stage can be accomplished by forming curved front edges of the filtering plates. Such curved front edges can be elliptical, parabolic, or hyperbolic, for example.

The embodiment of the invention particularly disclosed and described herein above is presented merely as an example of the invention. Other embodiments, forms, and modifications of the invention coming within the proper scope and spirit of the appended claims will, of course, readily suggest themselves to those skilled in the art.

What is claimed is:

1. A color changer system including a source of white light forming a light beam having a beam axis of propogation and a beam aperture through which the light beam passes, the beam aperture having a center coextensive with the axis of propogation, comprising, in combination, first color filter means positioned adjacent to the beam aperture and second color filter means positioned adjacent to the beam aperture opposite to said first color filter means, said first and second color filter means being movable across the beam aperture orthogonal to the beam axis, wherein selected light waves are deleted in predetermined amounts in accordance with the positions of said first and second color filter means so as to enhance a particular color contained in said light beam, said first and second color filter means being simultaneously movable into the light beam symmetrical to the beam axis of propogation so that distribution of color saturation of the light beam is symmetrical about the center of the beam aperture during movement of said first and second color filter means;

and each said first and second color filter means includes progressive variable filtering regions; and said first and second color filter means being movable to overlapping positions wherein said filtering regions are positioned across the beam apertures so that the effect of color enhancement of said particular color is additive.

2. The color changer system according to claim 1, wherein said filtering regions have color filtering material which are randomly diffused on said first and second color filter means.

3. The color changer system according to claim 2, wherein said first and second color filter means are first and second color filter plates slidingly positioned on opposite sides of the beam aperture,, said first and second plates being simultaneously slidably movable across the beam aperture to a plurality of selected positions so as to intercept said light beam and achieve a selected enhancement of said particular color.

4. The color changer system according to claim 2, wherein said first and second color filter means are first and second color filter disks positioned on opposite sides of the beam aperture, said first and second disks being rotatably movable across the beam aperture to a plurality of selected positions so as to achieve a selected enhancement of said particular color.

5. The color changer system according to claim 1, including a plurality of color filter means, each of said plurality of color filter means including at least said first color filter means positioned adjacent to the beam aperture and said second color filter means positioned adjacent to said aperture opposite to said first color filter means, said first and second color filter means being movable across the beam aperture, and each of said plurality of color filter means enhancing a different color.

6. The color changer system according to claim 1, wherein said first and second color filter means are first and second dichroic color filter means.

7. The color changer system according to claim 6, wherein said first and second dichroic color filter means each include a plurality of progressive variable filtering regions, each of said plurality of filtering regions having alternating clear portions and dichroic color filtering portions.

8. The color changer system according to claim 7, wherein said first and second dichroic color filter means include first and second dichroic color filter plates respectively slidingly positioned on opposite sides of the beam aperture, said first and second dichroic plates being simultaneously slidably movable across the beam aperture to a plurality of selected positions so as to achieve a selected enhancement of said particular color.

9. The color changer system according to claim 8, wherein said clear portions and said dichroic color filtering portions of said first dichroic plate complement said clear portions and said dichroic color filtering portions of said second dichroic plate when said first and second dichroic plates are moved into said overlapping positions wherein wavelengths of said light beam are filtered through only one of said first and second dichroic plates.

10. The color changer system according to claim 9, wherein said dichroic color filtering portions are distributed in progressively greater proportion relative to said clear portions of said first and second dichroic plates as said distributed progressive variable filtering regions increase the degree of color enhancement of said particular color.

11. The color changer system according to claim 10, wherein said clear portions and said dichroic color filtering portions are configured as elongated rectangular strips distributed in spaced relationship within each of said progressive variable filtering regions.

12. The color changer system according to claim 11, wherein said first and second dichroic color filter means include first and second dichroic color filtering disks, respectively, rotatably positioned on opposite sides of the beam aperture said first and second dichroic disks being simultaneously rotatably movable across the beam aperture to a plurality of selected positions so as to achieve a selected enhancement of said particular color.

13. The color changer system according to claim 12, wherein said clear portions and said dichroic color filtering portions of said first dichroic disk complement said clear portions and said dichroic color portions of said second dichroic filter disk when said first and second dichroic disks are moved into said overlapping positions wherein wavelengths of said light beam are filtered through only one of said first and second dichroic disks.

14. The color changer system according to claim 13, wherein said dichroic color filtering portions are distributed in progressively greater proportion relative to said clear portions of said first and second dichroic disks as said distributed progressive variable filtering region increase the degree of color enhancement of said particular color being transmitted.

15. The color changer system according to claim 14, wherein said first and second dichroic disks include a circumferential toroidal region wherein said variable filtering regions are positioned and are distributed in clear portions and said dichroic color filtering portions configured as arced strips distributed in spaced relationship within each of said progressive variable filtering regions.

16. The color changer system according to claim 15, wherein the beam aperture has an aperture diameter and said circumferential toroidal region has toroid width at least a equal to said aperture diameter, said toroidal region being positioned across the beam aperture, said first and second dichroic disks being rotatable so that said filtering regions are selectively positioned across the beam aperture.

17. The color changer according to claim 16, wherein the beam aperture has proximal and distal planes relative to said light source, said first and second dichroic disks being approximately parallel to said distal plane.

18. The color changer according to claim 16, wherein the beam aperture has proximal and distal planes relative to said light source, said first and second dichroic disks being approximately parallel to said proximal plane.

19. The color changer according to claim 3, wherein said first and second color filter plates have opposed front edges which come into filtering position across the light beam which come into filtering position across the light beam which come into intercepting position across the light beam as said first and second filtering plates are moved across the beam aperture, said front edges forming first and second notches, respectively, said first and second notches continuously defining a square during movement of said first and second filtering plates with the center of said square being coextensive with the beam axis.

20. The color changer according to claim 19, wherein said first and second notches are in the form of triangles defined by top, bottom and midpoints being capable in one position of said first and second plates of being positioned as follows: said top points meeting at the top of the vertical axis of the beam, said bottom points meeting at the bottom edge of the vertical axis of the light beam, and said midpoints being aligned with the horizontal axis of the light beam.

* * * * *